United States Patent [19]

Furutsu

[11] Patent Number: 4,538,754

[45] Date of Patent: Sep. 3, 1985

[54] FASTENER DISPENSING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 386,502

[22] Filed: Jun. 9, 1982

[30] Foreign Application Priority Data

Feb. 20, 1981 [JP] Japan ..... 56-23181

[51] Int. Cl.[3] ..... B65C 5/06

[52] U.S. Cl. ..... 227/67; 493/375

[58] Field of Search ..... 493/376, 375; 227/67

[56] References Cited

U.S. PATENT DOCUMENTS 4,310,962 1/1982 Suzuki ..... 227/67 X 4,402,446 9/1983 Suzuki ..... 227/67

*Primary Examiner*—James F. Coan

*Attorney, Agent, or Firm*—Blum Kaplan Friedman Silberman & Beran

[57] ABSTRACT

A fastener dispensing device including, in the proximity of a guide groove formed in the main body of the device for feeding a fastener assembly loaded in the device, a feeding mechanism which comprises a movable plate driven through the operation of a trigger of the device to reciprocate in a groove formed at a side of the guide groove for the fastener assembly and a feeder element mounted on the movable plate and formed with a claw part engageable with connection necks of fasteners of the fastener assembly and which, upon completion of dispensing a first fastener, brings a second fastener to the prescribed position rear of a hollow needle mounted in a nose portion of the device, without fail irrespective of a change or an irregularity in the pitch of the connection necks of fasteners.

8 Claims, 7 Drawing Figures

FASTENER DISPENSING DEVICE

BACKGROUND

The field of art to which the present invention belongs is concerned with a device for dispensing fasteners molded from a synthetic resin to a filament-like structure having a head and an anchor bar at one and the other ends thereof and dispensed in for example arranging a plurality of made-up goods in pairs or, more typically, in anchoring tags to various items of merchandise, and the device is often referred to also as a tag attacher.

More specifically, the invention relates to a fastener dispensing device which can without fail feed and dispense individual fasteners of a given fastener assembly one at each time of the operation of the device even where fastener assemblies different in the inter-fastener pitch are dealt with.

Fasteners termed above mean such products which are today widely utilized typically in or for anchoring various tags such as price tags for example to various commercial articles and which are therefore widely called tagging pins or, more briefly, tag pins. Thus, in the following description of the invention, reference will be made to tagging pins in representation of the fasteners.

Tagging pins are manufactured by molding a synthetic resin such as nylon, polypropylene and so forth, and as later to be described in greater detail, they individually comprise a filament having a head and an anchor bar or crossbar integrally formed at one and the other ends thereof. The filament has a connection neck comprising its end portion extended beyond the crossbar away the head, and through connection necks, a number of individual tagging pins are formed in series on their common connecting bar to the form of an integral assembly of pins. Tagging pins are manufactured in the form of assemblies as above, for reasons of an ease in the manufacture and also an ease in handling such as packaging, transportation, dispensing and so forth, and normally 20 to 50 pins are arranged on a single connecting bar. Further, for reasons to do with the fabrication of molds and for conveniences in loading in a dispensing device and dispensing by the device, tagging pins are formed at distances of the order of 2 mm on the connecting bar in most of tagging pin assemblies.

In dispensing operations, tagging pins are loaded in a dispensing device assembly by assembly, and are severed from the assembly and dispensed one at a time of the operation of the device. As later to be described in greater detail, the dispensing device has a pistol-type overall structure, and broadly it comprises a lever or trigger adapted to rock relative to a main body having a slot-provided hollow needle removably mounted at a nose portion thereof. An arrangement is made such that when the trigger is operated, individual tag pins are successively severed from a tag pin assembly loaded in a guide groove formed in a part of the main body rear of the hollow needle and successively fed to the prescribed point in the groove, and are dispensed through the needle with the crossbar or anchor bar applied through an article or articles.

In conventional fastener dispensing devices, use is made of a toothed wheel for the mechanism for feeding tag pins individually successively to the prescribed point for shooting in the device, and an arrangement is made such that with a tooth of the wheel engaged between adjacent connection necks on the connecting bar of a loaded tag pin assembly, the toothed wheel is rotated one tooth distance at a time by rocking the trigger so as to perform feeding of the tag pin assembly.

As before stated, the distance between each adjacent tagging pins on the connecting bar is in most cases 2 mm approximately, and the distance between each adjacent connection necks is also about 2 mm, therefore.

Whereas the inter-pin distance or pitch is almost fixed as above for reasons indicated before, it has of late been increasingly required to alter the inter-pin pitch: This is not only because it is advantageous from the viewpoint of thermal economy to make molds smaller and thereby reduce the thermal capacity of molds, but also because it is also advantageous if molds can be produced at a reduced cost.

Further, in case it is desired to manufacture tagging pins having a greater filament length, it is required to accordingly increase the inter-pin pitch.

When the inter-pin pitch is thus altered or in case of any irregularity in the pitch attributable for example to an error in the manufacture of tag pin assemblies, an inconvenience is met with the feeding mechanism in conventional devices. That is to say, in conventional tag attachers teeth of a toothed wheel are engaged between connection necks of tagging pins, therefore if a change occurs in the distance or pitch between pins or their connection necks, the toothed wheel can no longer effectively mesh with its teeth, with the connection necks of tagging pins. Thus, insofar as tag pin assemblies to be dispensed all have about 2 mm for the pitch of the connection necks, conventional fastener dispensing devices can be effectively relied on in tag attaching operations, but they cannot effectively perform feeding of tag pin assemblies if the latter have any other pitch of the connection necks, inconveniently. A same as this is applicable also in case an irregularity exists in the arrangement of pins in a single pin assembly.

SUMMARY

Accordingly, a primary object of the present invention is to eliminate the above indicated shortcoming with conventional fastener dispensing devices or tag attachers.

Another object of the invention is to provide an improved fastener dispensing device which can dispense tag pins of a tag pin assembly loaded therein one at a time without fail, even in case tag pin assemblies varied in the pitch of connection necks are handled or in case a tag pin assembly involves an irregularity in the pitch in reference.

A still another object of the invention is to provide a fastener dispensing device having a feeding mechanism which can feed the tag pin assembly one pin at each operation of the device without fail, irrespective of a difference or irregularity in the pitch of the connection necks as above.

These and other objects of the invention which will become apparent as the description proceeds can be attained in accordance with the present invention by providing a fastener dispensing device to be described in brief as follows:

The device comprises a main body having removably mounted in a front end or nose portion thereof a hollow needle formed with a side slot, the main body having a guide groove for the fastener assembly provided at a location rear of the hollow needle and extended in a direction perpendicular to the axis of the needle, a lever or trigger disposed in front of a grip part of the main body in a manner capable of rocking in backward and forward directions relative to the main body, the lever being operable to let a pushing rod enter the hollow of the needle so that individual fasteners of the fastener assembly loaded in the guide groove are successively dispensed one at a time with their crossbars passed through the hollow needle, the device being characterized in that it further comprise a feeding mechanism provided in the proximity of the guide groove, which is adapted to engage the connection necks of fasteners and, upon completion of dispensing a first fastener, bring a second fastener to the prescribed position within the main body rear of the hollow needle, irrespective of a change or an irregularity with respect to the pitch of the connection necks of fasteners.

Preferably, the feeding mechanism comprises a movable plate member driven by the operation of the trigger to reciprocate in and along a groove provided inside the main body at a side of the guide groove for the fastener assembly, and a feeder element mounted on the movable plate and formed with a claw part engageable with the connection necks of fasteners or of the fastener assembly in a manner such that when the trigger or lever is operated, it is brought in and out of contact with the connection necks. Further, an arrangement is made such that when the movable plate undergoes descending along the groove, the feeder element engages the connection neck and feed the fastener assembly a distance as prescribed.

The claw part may preferably comprise the form of a bird's bill, and it may be provided in a plurality to the feeder element.

These and other features and advantages of the fastener dispensing device according to the present invention will be more clearly appreciated from considering the following description of preferred embodiments of the invention, taken in conjunction with the accompanying drawings.

DRAWINGS

Figure 5:
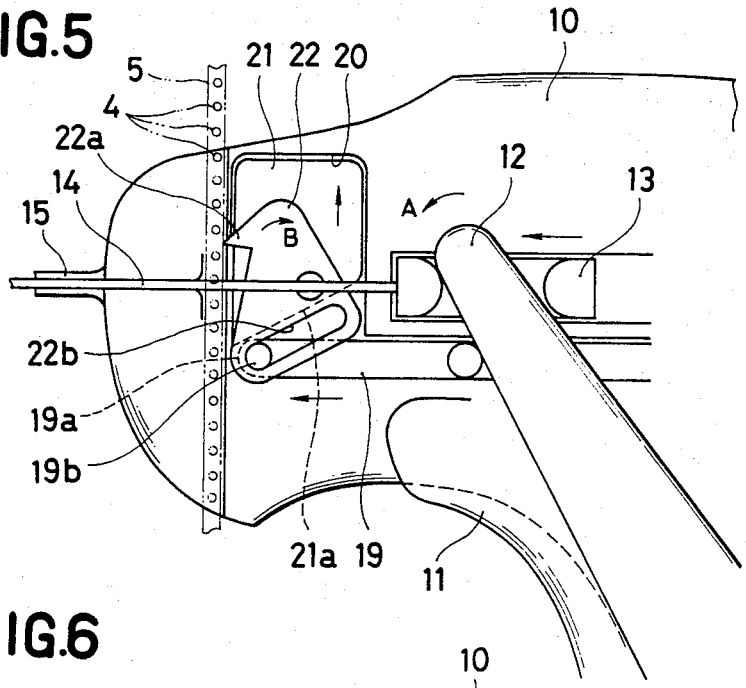
Figure 6:
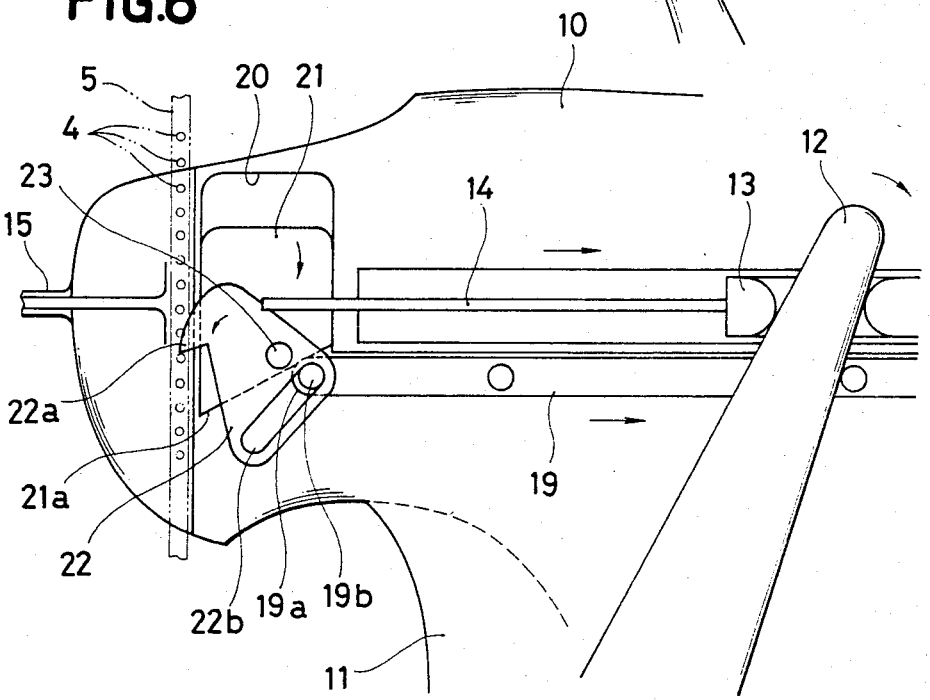
Figure 7:
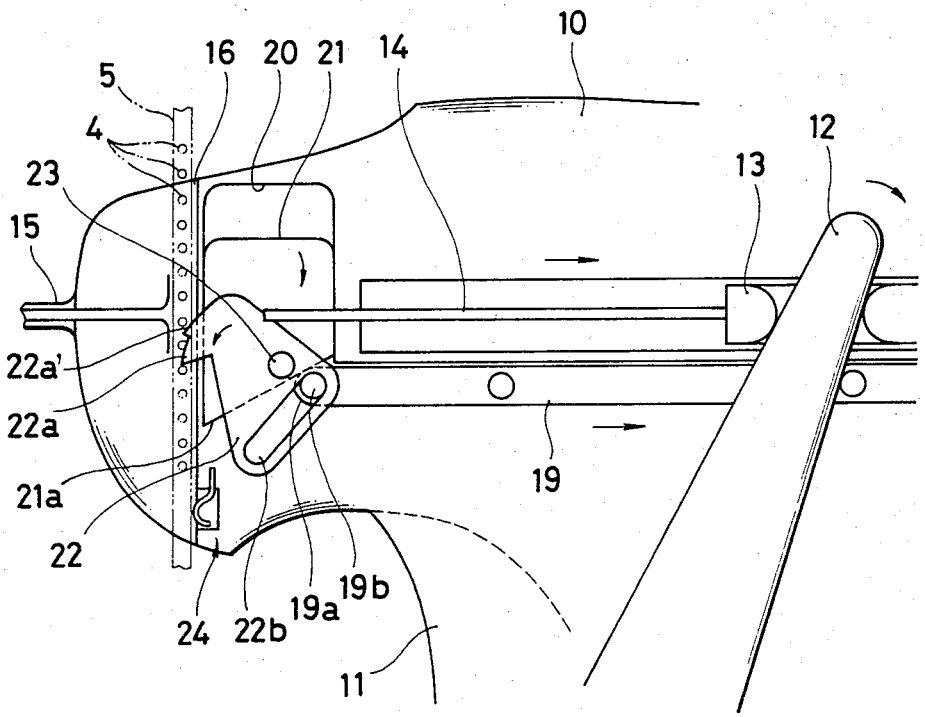

FIGS. 5 and 6 respectively show a front view of a feeding mechanism in the fastener dispensing device in accord with the present invention, taken for illustration of the feeding mechanism in different operation conditions; and FIG. 7 shows a front view of a modified example of the feeding mechanism according to the present invention.

PREFERRED EMBODIMENTS

Prior to entering a detailed description of the present invention per se, a brief review will be given the fastener or tag pin assembly and a conventional dispensing device, for facilitating perception of the concept of the invention.

Figure 1:
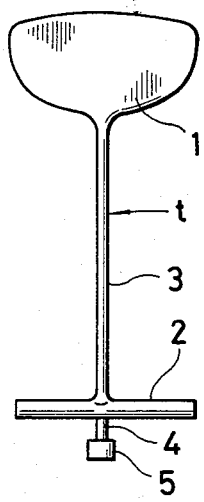
FIG.1 PRIOR ART
FIG. 1 shows a front view of an example of fastener or tag pin assemblies.
Figure 2:
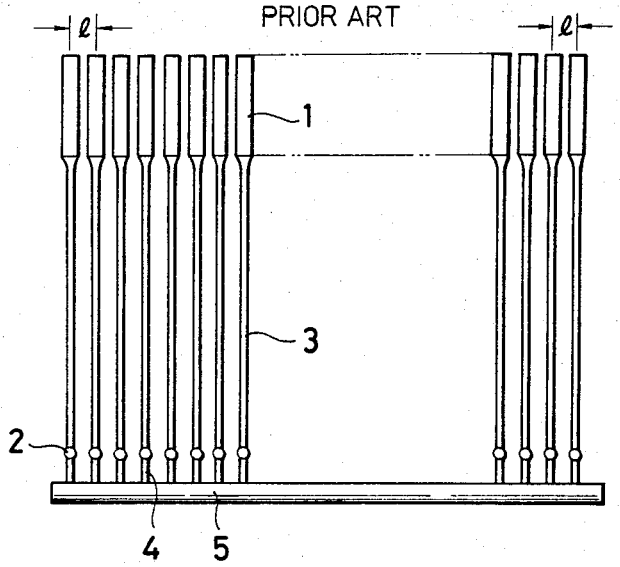
FIG.2 PRIOR ART
FIG. 2 is a side elevational view of FIG. 1.

As shown in FIGS. 1 and 2, the fastener or tag pin indicated by letter t which the dispensing device of the invention is intended to deal with, comprises a head 1 by which to hold a tag in position, a filament 3 and an anchor bar or crossbar 2 applied through an article such as a fabric for example and anchored thereto. At an end remote from the head 1, the filament 3 has a connection neck 4 comprising an end portion extended beyond the crossbar, and through connection necks 4, a plurality of fasteners t are series arranged at pitch l on their common connecting bar or rod 5 to the form of an integral assembly T resembling a comb.

Figure 3:
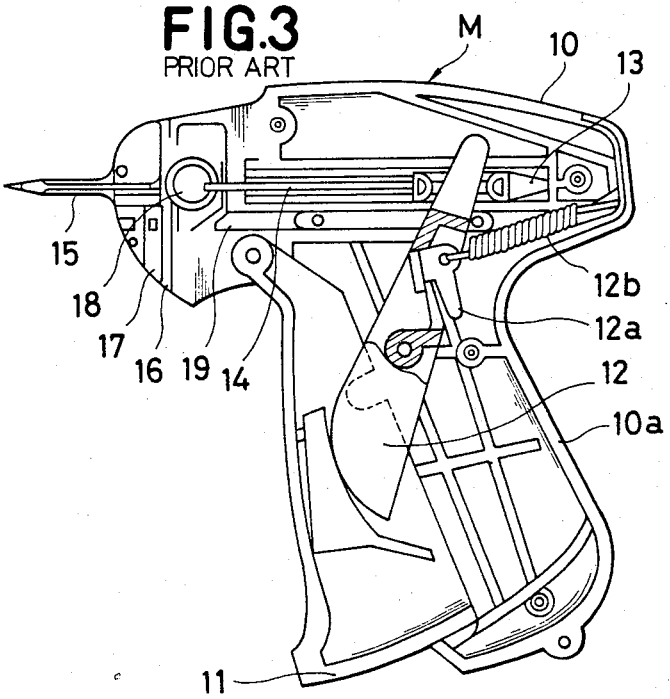
FIG.3 PRIOR ART
FIG. 3 is a sectional side view of a conventional fastener dispensing device.

An example of the existing devices for dispensing tag pins t is shown at M in FIG. 3. As shown, this device comprises a main body 10 which includes a grip part 10*a*, to which a lever or trigger 11 is rockably mounted. The motion of the lever 11 is transferred through a second or an intermediate lever 12 to a slider 13 so that a pushing rod 14 is driven toward a hollow needle 15 formed with a side slot, whereby the crossbar 2 of the tag pin t located at the prescribed position rear of the needle 15 is pushed in the hollow needle 15 applied through an article and it is applied through the article. By retracting the needle out of the article, the fastener is anchored with its crossbar to the article, to accomplish a tagging operation.

In a front end or nose portion, the dispensing device M is formed with a guide groove 16, in which the connection bar or rod 5 of the fastener assembly is received and fed toward below. When the crossbar 2 of the fastener t is passed in the hollow needle 15, the connection neck 4 of that fastener is cut by a cutter blade 17.

Figure 4:
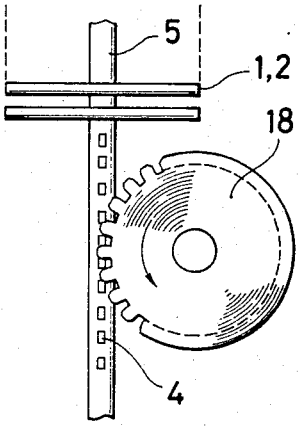
FIG.4 PRIOR ART
FIG. 4 shows a front view of a feeding mechanism in conventional fastener dispensing devices.

As shown in FIG. 4, the fastener feeding mechanism in conventional dispensing devices M comprises a toothed wheel 18, which is mesh engaged with connection necks 4 standing on the connecting bar 5, and by moving a slide bar 19 accompanying a rocking motion of the trigger 11, a ratchet is driven through a cam mechanism (not shown) to rotate the toothed wheel 18 a tooth distance at a time to thereby feed the tag pins t.

Now that the teeth of the toothed wheel 18 are engaged between adjacent connection necks 4 and 4 of fasteners or tag pins t, if the pitch l of the arrangement of connection necks 4 is once changed, such pitch will no longer match the pitch of the toothed wheel 18. That is to say, in order to carry out fastener dispensing operations in connection with fastener assemblies varied in the inter-pin pitch or the pitch of the connecting necks, l, it is necessary to preparatively provide toothed wheels accordingly varied in the tooth pitch and operate replacement of toothed wheels selectively one with the other as the fastener assembly is changed with respect to the pitch of connection necks. This is extremely detrimental to attain a high operation efficiency.

The present invention aims at eliminating such difficulty, in a simple manner.

Now, a detailed description will be entered in connection with the present invention, in conjunction with the illustrated embodiments thereof, by way of example.

FIG. 5 is a front view of an essential part of the device of the invention, and shows an operation condition in which a fastener dispensing is being processed. Then, FIG. 6 shows a similar view to the one of FIG. 5, and in the condition illustrated in this FIG. 6, the fastener dispensing operation has been finished and an operation for feeding the fastener assembly is then being processed. Same parts and members in FIGS. 5 and 6 as those in FIG. 3 are shown by same reference characters as in FIG. 3.

At a portion rear of the guide groove 16 provided in a front end portion of the main body 10, there is formed a groove or cavity 20, in which a movable plate 21 is received in a manner capable of sliding up and down along the guide groove 16. This moving plate 21 is formed at its lower end in the form of an inclined cam face 21*a*, with which a front end portion 19*a* of the slide bar 19 contacts to let the moving plate 21 to ascend, the slide bar 19 being driven to reciprocate through the intermediate lever 12. This lever 12 is pivotally supported so as to rock when the trigger 11 is operated, and it normally is actuated to let its lower end portion with which it engages the trigger 11 to protrude out of the grip part 10*a*, through the function of a spring 12*b* incorporated between a rear wall portion of the main body 10 and a spring support 12*a* mounted on the lever 12.

The plate 21 has a feeder element 22 rockably mounted thereto through a pin 23, and the feeder element 22 has formed thereto a claw part 22*a* which engages between connection necks 4 of the fastener assembly. At a lower portion, the feeder element 22 has a slit 22*b* extended along its lower edge, fitted in which slit is a projection 19*b* provided at a side in a front end portion of the slide bar 19, whereby as the slide bar 19 is moved backward and forward, the feeder element 22 can be rocked with the pin 23 as the fulcrum for the rocking motion.

As shown in FIG. 7, it is with ease feasible to provide to the feeder element 22 an auxiliary claw part 22*a*', which may be provided in addition to the claw part 22*a* and at a suitable distance from the latter. According to this modified arrangement, if the engagement of the claw part 22*a* accidentally fails to be made in a sufficient depth between the connection necks 4 and 4, such failure will be effectively made up for by the function of the auxiliary claw part 22*a*' and a continuous feeding of fasteners can be further facilitated.

Also in the embodiment illustrated in FIG. 7, as indicated at 24 there is a resilient pressing member or stopper provided in a manner of projecting in part in a portion of the groove 16 below the feeder element 22. This stopper 24 functions to apply resistance to the connecting bar 5 of the fastener assembly: If it is anticipated that for example when the feeder element 22 undergoes a return motion from its position shown in FIG. 6 in the direction shown by arrow B in FIG. 5, the fastener assembly is permitted to move in the guide groove 16 in the direction opposite the feeding direction, the resilient member 24 can effectively prevent such backward motion of the fastener assembly from occurring. It will be readily understood that the member 24 can be incorporated also in the embodiment of the invention illustrated in FIGS. 5 and 6.

In dispensing or shooting a fastener with the device according to the present invention, the intermediate lever 12 is rocked in the direction of arrow A shown in FIG. 5 to advance the slider 13, whereby through the pushing rod 14 the crossbar of the fastener is forced into the hollow needle 15 and further through an object such as a garment. At the same time, by the function of the intermediate lever 12 the slide bar 19, too, is moved to advance with the front end portion 19*a* thereof brought to contact the cam face 21*a* and push the latter toward up, whereby the movable plate 21 is caused to rise or ascend. During this ascending of the plate 21, the feeder element 22 is rotated by the function of the projection 19*b* with the pin 23 as the fulcrum for the rotation in the direction shown by arrow B in FIG. 5, that is, in the direction in which the claw part 22*a* moves away the connection neck 4 of the fastener, so that an inconvenience can be effectively avoided that the claw part 22*a* hooks the connection neck 4 to drive the connecting bar 5 toward up.

When a first fastener has been thus dispensed through an article, the pulling or gripping of the trigger 11 may be released, upon which the intermediate lever 12 is rocked in the opposite direction to return to its original position, when the slide bar 19, too, undergoes a return stroke together with the pushing rod 14. When the slide bar 19 undergoes the return stroke, the feeder element 22 is rotated by the projection 19*b* with the pin 23 as the fulcrum for the rotation, in the direction opposite the direction shown by arrow B, that is, in the direction in which the claw part 22*a* is moved toward the connection necks 4, and the claw part 22*a* is brought into engagement between connection necks 4 and 4. Accompanying the return motion of the slide bar 19, further, the feeder element 22 undergoes descending together with the movable plate 21. During this descending of members, the feeder element 22 is applied with a force by the projection 19*b* to rotate in the direction opposite that shown by arrow B, so that it can strongly engage between connection necks 4 and 4 and can pull down the connecting bar, as shown in FIG. 6. Through the above operation, the fastener assembly can be fed toward below by the distance corresponding to the dispensed single fastener.

As described above, it is arranged according to the present invention that by operation of the lever the claw part of feeder element is securely engaged between two adjacent connection necks on a fastener assembly and that the feeder element is moved together with the movable plate along the guide groove for the connecting bar of the fastener assembly. Accordingly, the fastener assembly can be fed in the dispensing device without fail regardless the specification concerning the pitch of the connecting necks of the fastener assembly. That is to say, the fastener dispensing operation can be carried out free of an influence of a change in the pitch of connection necks.

Although the invention has been described in connection with specific embodiments thereof, this is only by way of illustration, and it will be apparent to those skilled in the art that various modifications and design changes can with ease be made without departing from the concept of the invention. For example, a description has been made in connection with such an arrangement in which as the slide bar 19 undergoes a return motion, the movable plate 21 is permitted to undergo a spontaneous descending on account of its own weight, but it will be readily devised that in order to attain an enhanced certainty in this respect, a spring means may be incorporated, actuating the movable plate 21 toward below.

We claim:

1. A fastener dispensing device for dispensing one at a time a plurality of fasteners loaded in the device in the form of an integral assembly, each fastener comprising a filament having a head and a crossbar at one and the other ends thereof and having a connection neck comprising an end portion extended beyond the cross bar at an end remote from the head, said plurality of fasteners being connected through their connection necks to a connecting bar to form said integral assembly, the device comprising a main body having a grip part and, removably mounted in a front end portion thereof, a hollow needle formed with a side slot, and further having a guide for the fastener assembly formed at a location at the rear of the hollow needle and extending in a direction perpendicular to the longitudinal axis of the needle; a lever mounted in front of the grip part of the main body in a manner capable of rocking in backward and forward directions relative to the main body a pushing rod operably coupled to the lever for displacement of the pushing rod into the hollow of the hollow needle so that individual fasteners of the fastener assembly loaded in the guide are successively dispensed one at a time with their crossbars passed through the hollow needle; the device further comprising a feeding mechanism provided in the proximity of the guide groove adapted to engage the connection necks of fasteners and, upon completion of dispensing a first fastener, to bring a second fastener to the prescribed position within the main body at the rear of the hollow needle, irrespective of a change or an irregularity with respect to the pitch of the connection necks of the fasteners on the connecting bar of the fastener assembly, said feeding mechanism comprising a movable plate driven by said lever to reciprocate in and along a further guide formed inside the main body at a side of said guide for the fastener assembly, said movable plate being formed with an inclined cam face along the lower edge thereof, a slide bar mounted to intermittently engage said inclined cam face, said slide bar being driven to reciprocate to intermittently move said movable plate to ascend and decend, and a feeder element pivotably mounted on said movable plate and formed with at least one claw part engagable with the connection necks of fasteners in a manner such that when said lever is operated it is brought into and out of contact with the connection necks, said feeder element being brought into engagement with a connection neck to feed the fastener assembly when said movable plate descends in said further guide, said feeder element being formed with a slit in which said slide bar is engaged, said claw part being rocked in a direction away from the connection necks of the fasteners when said feeder element ascends.

2. A fastener dispensing device as claimed in claim 1, which further comprises means for applying resistance to the connecting bar of the fastener assembly, said means being disposed in the vicinity of said guide groove for the fastener assembly.

3. A fastener dispensing device as claimed in claim 1, wherein said further guide for the movable plate is a groove formed inside the main body.

4. A fastener dispensing device as claimed in claim 1, wherein said feeder element is rockably engaged with said moving plate through a pin.

5. A fastener dispensing device as claimed in claim 1, which comprises a second lever driven by said first-mentioned lever, said slide bar being driven by said second lever, said slide bar having a projection provided at a front end portion thereof, said projection being engaged in a slit formed along the lower edge of feeder element.

6. A fastener dispensing device as claimed in claim 1, wherein said feeder element has a single claw part.

7. A fastener dispensing device as claimed in claim 1, wherein said feeder element has a plurality of claw parts.

8. A fastener dispensing device as claimed in claim 1, wherein said claw part of said feeder element is of the form of a bird's bill.

* * * * *